US008714690B2

(12) United States Patent
Rzadca et al.

(10) Patent No.: US 8,714,690 B2
(45) Date of Patent: May 6, 2014

(54) TESTING OF NOZZLES USED IN PRINTING SYSTEMS

(75) Inventors: Mark C. Rzadca, Fairport, NY (US); Lynn Schilling-Benz, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 211 days.

(21) Appl. No.: 13/435,050

(22) Filed: Mar. 30, 2012

(65) Prior Publication Data

US 2013/0257968 A1 Oct. 3, 2013

(51) Int. Cl.

| | |
|---|---|
| ***B41J 29/38*** | (2006.01) |
| ***B41J 29/393*** | (2006.01) |
| ***B41J 2/015*** | (2006.01) |
| ***B41J 2/14*** | (2006.01) |

(52) U.S. Cl.
USPC ..... 347/19; 347/9; 347/20; 347/47

(58) Field of Classification Search
USPC ..... 347/9, 19–20, 47
See application file for complete search history.

(56) References Cited

U.S. PATENT DOCUMENTS

| | | | | |
|---|---|---|---|---|
| 4,516,006 | A * | 5/1985 | Kobayashi et al. | 218/57 |
| 2007/0052748 | A1 * | 3/2007 | Sarnoff et al. | 347/19 |

OTHER PUBLICATIONS

G. Settles, *Schlieren and Shadowgraph Techniques: Visualizing Phenomena in Transparent Media*, Springer Verlag Berlin, Heidelberg, New York, 2001.

G. Settles, *Important Developments in Schlieren and Shadowgraph Visualization During the Last Decade*, ISFV14-14th International Symposium on Flow Visualization, Jun. 21-24, 2010, EXCO Daegu Korea.

K. A. Phalnikar et al., *Experiments on Free Impinging Supersonic Microjets*, Exp Fluids 2009, 44:819-830.

A. Vogel et al., *Sensitive High-Resolution White-Light Schlieren Technique With a Large Dynamic Range for the Investigation of Ablation Dynamics*, Optics Letters, vol. 31, No. 12, Jun. 15, 2006.

* cited by examiner

*Primary Examiner* — Jason Uhlenhake
(74) *Attorney, Agent, or Firm* — Nancy R. Simon; Amit Singhal

(57) ABSTRACT

A method for testing a nozzle in a nozzle plate includes setting an angle of the nozzle plate with respect to an optical axis of a schlieren optical system to a first angle, jetting gas through the nozzle, forming a first light-intensity representation of the gas stream jetting from the nozzle using the schlieren optical system, and capturing a first image of the first light-intensity representation. The angle of the nozzle plate with respect to the optical axis of the schlieren optical system is then adjusted to a different second angle. A second light-intensity representation of the gas stream jetting from the nozzle is formed using the schlieren optical system and a second image of the second light-intensity representation is then captured. The first and second images can be analyzed to determine whether the nozzle is functioning properly.

4 Claims, 11 Drawing Sheets

TESTING OF NOZZLES USED IN PRINTING SYSTEMS

CROSS REFERENCE TO RELATED APPLICATIONS

Reference is made to commonly-assigned, U.S. patent application Ser. No. 13/435,025, entitled "TESTING OF NOZZLES USED IN PRINTING SYSTEMS", Ser. No. 13/435,039, entitled "TESTING OF NOZZLES USED IN PRINTING SYSTEMS", all filed concurrently herewith.

TECHNICAL FIELD

The present invention generally relates to inkjet printing systems and more particularly to a system and method for testing nozzles used to jet ink or fluid in inkjet printing systems.

BACKGROUND

In commercial inkjet printing systems, a print media is physically transported through the printing system at a high rate of speed. For example, the print media can travel 650 feet per minute. The lineheads in commercial inkjet printing systems typically include multiple nozzle plates, with each nozzle plate having precisely spaced and sized nozzles arranged in a nozzle array. The cross-track pitch, measured as drops per inch or dpi, is determined by the nozzle spacing. The dpi can currently be as high as 600, 900, or 1200 dpi.

A reservoir containing ink or some other material typically is behind each nozzle plate in a linehead. Ink streams through the nozzles in the nozzle plates when the reservoirs are pressurized. The nozzles in the nozzle plates can be very small in size, such as several microns in diameter. Ideally, the nozzles are fabricated to be identical and emit or "jet" parallel streams or drops of ink to produce a uniform density on the print media. But in practice the nozzles are not identical and do not always jet parallel ink drops or streams. Failures in drop deposition can produce artifacts in the content printed on the print media. For example, a blank streak is created when a nozzle stops ejecting ink drops. The blank streak lasts until ink is again ejected from the nozzle.

On the other hand, a "stuck on" jet will produce a dark line for the duration of the "stuck on" event. And the drops ejected from a crooked nozzle frequently intersect with or lie closer to one or more of the neighboring streams to produce a darker streak where the conjoined streams land on the print media and an adjacent lighter streak (or streaks) where the deviated streams are missing from the intended region of the print media.

These artifacts continue until the problem is corrected. Unfortunately, the necessary corrections may not occur for hundreds or thousands of feet of print media, which results in waste when the printed content is not usable. Additionally, wasted print media causes the print job to be more costly and time consuming.

Direct optical inspection of the nozzle plate to determine the straightness of streams from the nozzles is difficult due to the small size of the nozzles. A current method for testing the straightness of streams jetted from the nozzles involves assembling the nozzle plates into a linehead and after the linehead is assembled, testing the nozzle plates to determine if the streams indicate the nozzles are of sufficient quality. This requires a significant amount of time and effort. If one or more streams indicate a nozzle is of inadequate quality, the non-conforming nozzle plate or plates must be removed from the linehead. Removal of the non-conforming nozzle plates further increases the cost of manufacturing of the lineheads. The removal also reduces the manufacturing throughput of lineheads.

SUMMARY

In one aspect, a system for testing a nozzle in a nozzle plate can include a fixture for holding the nozzle plate; a gas input device for jetting gas through the nozzle; a first schlieren optical system that produces a light-intensity representation of a gas stream jetted from the nozzle; and a first image capture device for capturing an image of the light-intensity representation of the gas stream jetted from the nozzle.

According to another aspect, the system can include a computing device connected to the image capture device. The computing device can be used to process, store, or analyze the images captured by the image capture device.

According to another aspect, the system can include a motorized system for adjusting a relative angle between the nozzle plate and an optical axis of the schlieren optical system.

According to another aspect, the first schlieren optical system can be a first stationary schlieren optical system. The system can include a second stationary schlieren optical system and a second image capture device, where an angle between the nozzle plate and an optical axis of the first stationary schlieren optical system is different from an angle between the nozzle plate and an optical axis of the second stationary schlieren optical system.

According to another aspect, a method for testing a nozzle in a nozzle plate can include jetting gas through the nozzle; forming a light-intensity representation of a gas stream jetted from the nozzle using at least one stationary schlieren optical system; and capturing one or more images of the light-intensity representation of the gas stream jetted from the nozzle.

According to another aspect, a method for testing a nozzle in a nozzle plate can include jetting gas through the nozzle; forming one or more light-intensity representations of a gas stream jetted from the nozzle using at least one stationary schlieren optical system; and projecting onto a screen respective light-intensity representations of the gas stream jetted from the nozzle.

According to another aspect, a method for testing a nozzle in a nozzle plate can include setting an angle of the nozzle plate with respect to an optical axis of a schlieren optical system to a first angle; jetting gas through the nozzle; forming a first light-intensity representation of the gas stream jetting from the nozzle using the schlieren optical system; capturing a first image of the first light-intensity representation; adjusting the angle of the nozzle plate with respect to the optical axis of the schlieren optical system to a different second angle; forming a second light-intensity representation of the gas stream jetting from the nozzle using the schlieren optical system; and capturing a second image of the second light-intensity representation.

BRIEF DESCRIPTION OF THE DRAWINGS

Embodiments of the invention are better understood with reference to the following drawings. The elements of the drawings are not necessarily to scale relative to each other.

DETAILED DESCRIPTION

Figure 1:
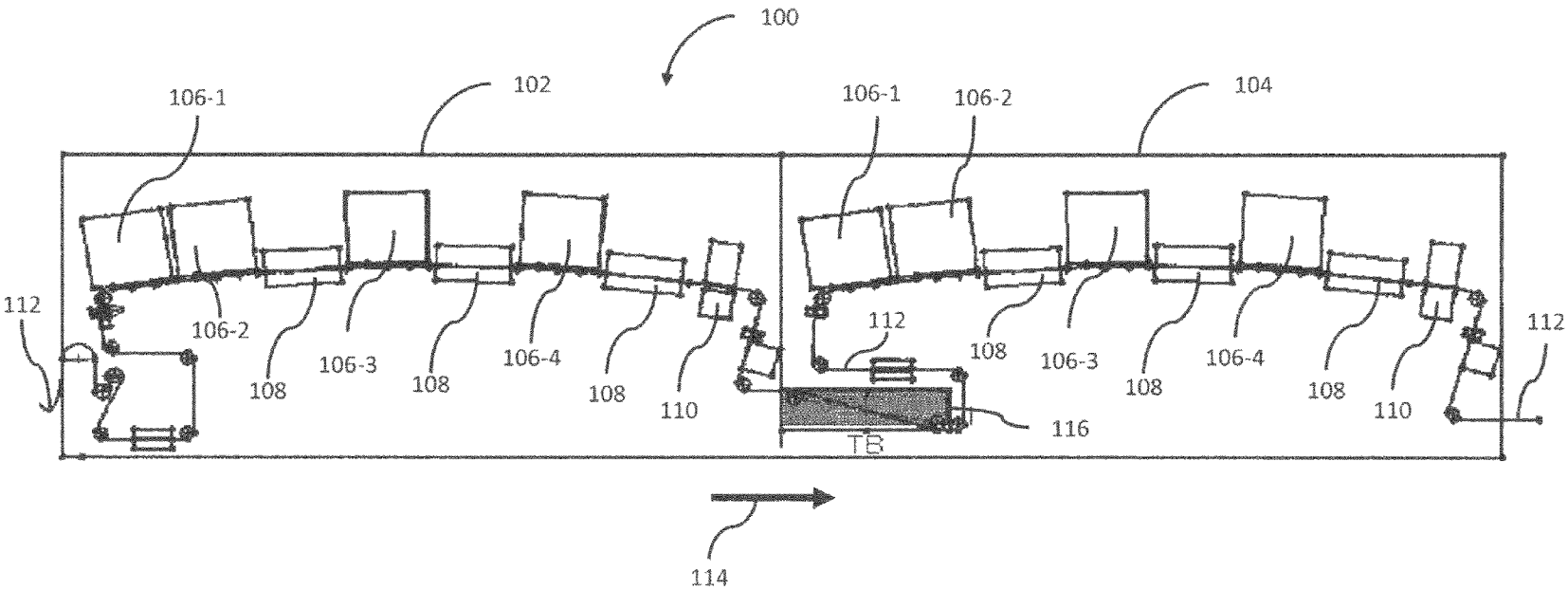
FIG. 1 illustrates one example of a continuous web inkjet printing system in an embodiment in accordance with the invention.

Throughout the specification and claims, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) being described. Because components of embodiments of the present invention can be positioned in a number of different orientations, the directional terminology is used for purposes of illustration only and is in no way limiting.

The embodiments described herein refer to schlieren optical systems, however shadowgraph techniques can be used as well. With shadowgraph, deflection of light rays is caused by an index of refraction variation similar to schlieren optical systems, however no spatial filter (knife edge or other type) is used to block light rays. The interchangeability of schlieren and shadowgraph systems will be apparent to one of ordinary skill in the art. As such, the term schlieren optical system, as used herein, is intended to be generic and not specific to either schlieren or shadowgraph systems.

The present description will be directed in particular to elements forming part of, or cooperating more directly with, a system in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention are applied to nozzle plates typically used in inkjet printing systems. However, many other applications are emerging which use inkjet printheads or similar nozzle arrays to emit fluids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. In addition, a nozzle array can jet out gaseous material or other fluids. As such, as described herein, the terms "liquid", "ink" and "inkjet" refer to any material that is ejected by a nozzle array.

Inkjet printing is commonly used for printing on paper. However, printing can occur on any substrate or receiving medium. For example, vinyl sheets, plastic sheets, glass plates, textiles, paperboard, corrugated cardboard, and even human or animal tissue or skin can comprise the print media. Additionally, although the term inkjet is often used to describe the printing process, the term jetting is also appropriate wherever ink or other fluid is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting drops so that print drops reach the print medium and non-print drops are caught. Various approaches for selectively deflecting drops have been developed including electrostatic deflection, air deflection, and thermal deflection.

Additionally, there are typically two types of webs used with inkjet printing systems. The first type is commonly referred to as a continuous web while the second type is commonly referred to as a cut sheet(s). The continuous web of print media refers to a continuous strip of print media, generally originating from a source roll. The continuous web of print media is moved relative to the inkjet printing system components via a web transport system, which typically includes drive rollers, web guide rollers, and web tension sensors. Cut sheets refer to individual sheets of print media that are moved relative to the inkjet printing system components via a support mechanism (e.g., rollers and drive wheels or a conveyor belt system) that is routed through the inkjet printing system.

The invention described herein is applicable to both types of printing technologies. As such, the term printhead, as used herein, is intended to be generic and not specific to either technology. Additionally, the invention described herein is applicable to both types of webs. As such, the term web, as used herein, is intended to be generic and not as specific to one type of web or the way in which the web is moved through the printing system. Additionally, the terms printhead and web can be applied to other nontraditional inkjet applications, such as printing conductors on plastic sheets or medicines or materials on skin.

Figure 2:
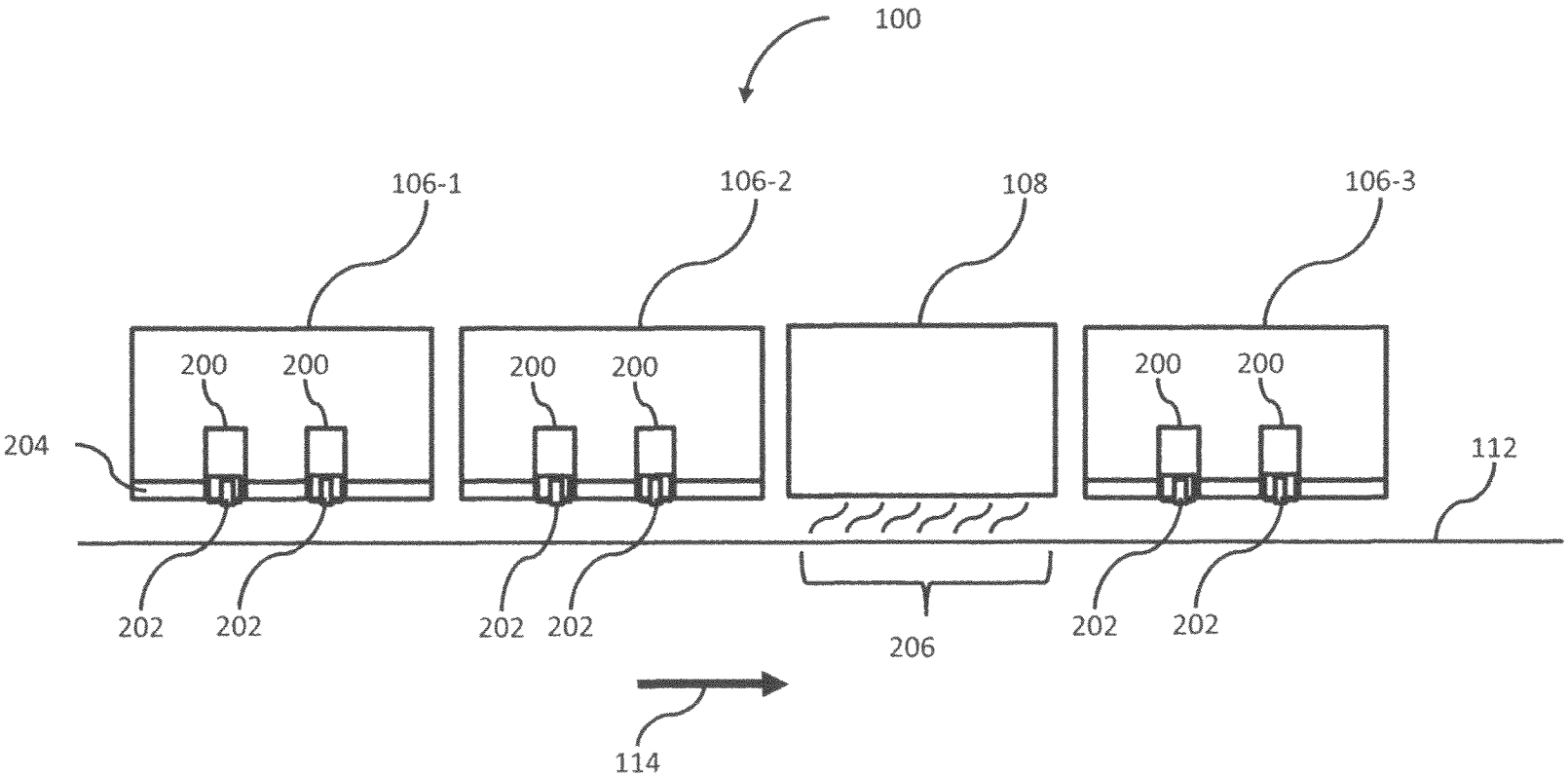
FIG. 2 depicts a portion of printing system 100 in more detail.

The terms "upstream" and "downstream" are terms of art referring to relative positions along the transport path of the print media; points on the transport path move from upstream to downstream. In FIGS. 1 and 2, the media moves from left to right as indicated by transport direction arrow 114, while in FIG. 3 the media moves from top to bottom as indicated by the transport direction arrow 114. Where they are used, terms such as "first", "second", and so on, do not necessarily denote any ordinal or priority relation, but are simply used to more clearly distinguish one element from another.

Referring now to the schematic side view of FIG. 1, there is shown one example of a continuous web inkjet printing system in an embodiment in accordance with the invention. Printing system 100 includes a first printing module 102 and a second printing module 104, each of which includes lineheads 106, dryers 108, and a quality control sensor 110. Each linehead 106 typically includes multiple printheads (not shown) that apply ink or another fluid (gas or liquid) to the surface of the print media 112 that is adjacent to the printheads. For descriptive purposes only, the lineheads 106 are labeled a first linehead 106-1, a second linehead 106-2, a third linehead 106-3, and a fourth linehead 106-4. In the illustrated embodiment, each linehead 106-1, 106-2, 106-3, 106-4 applies a different colored ink to the surface of the print media 112 that is adjacent to the lineheads. By way of example only, linehead 106-1 applies cyan colored ink, linehead 106-2 magenta colored ink, linehead 106-3 yellow colored ink, and linehead 106-4 black colored ink.

The first printing module 102 and the second printing module 104 also include a web tension system that serves to physically move the print media 112 through the printing system 100 in the transport direction 114 (left to right as shown in the figure). The print media 112 enters the first printing module 102 from a source roll (not shown) and the linehead(s) 106 of the first module applies ink to one side of the print media 112. As the print media 112 feeds into the second printing module 104, a turnover module 116 is adapted to invert or turn over the print media 112 so that the linehead(s) 106 of the second printing module 104 can apply ink to the other side of the print media 112. The print media 112 then exits the second printing module 104 and is collected by a print media receiving unit (not shown).

FIG. 2 illustrates a portion of printing system 100 in more detail. As the print media 112 is directed through printing system 100, the lineheads 106, which typically include a plurality of printheads 200, apply ink or another fluid onto the print media 112 via the nozzle arrays 202 of the printheads 200. The printheads 200 within each linehead 106 are located and aligned by a support structure 204 in the illustrated embodiment. After the ink is jetted onto the print media 112, the print media 112 passes beneath the one or more dryers 108 which apply heat 206 to the ink on the print media.

Figure 3:
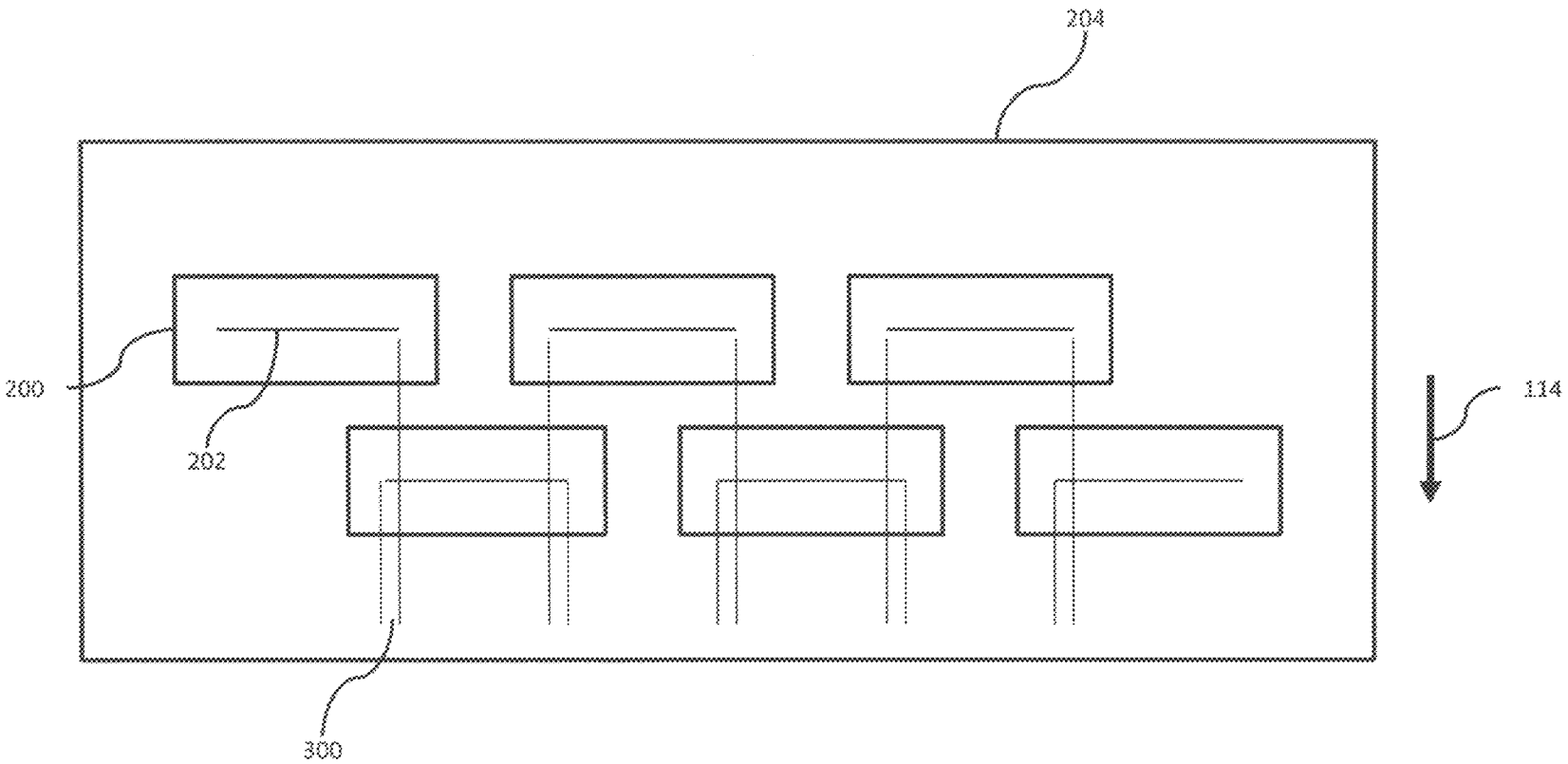
FIG. 3 illustrates a side of the support structure 204 that is adjacent to a web in an embodiment in accordance with the invention.

Referring now to FIG. 3, there is shown a side of the support structure 204 that is adjacent to a web in an embodiment in accordance with the invention. The printheads 200 can be aligned in a staggered formation, with upstream and downstream printheads 200, such that the nozzle arrays 202 produce overlap regions 300. The overlap regions 300 enable the print from overlapped printheads 200 to be stitched together without a visible seam through the use of appropriate stitching algorithms that are known in the art. These stitching algorithms ensure that the amount of ink printed in the overlap region 300 is not higher than other portions of the print.

In a commercial ink jet printing system, such as the printing system depicted in FIG. 1, the printheads 200 are typically 4.25 inches wide and multiple printheads 200 are used to cover the varying widths of different types of print media. For example, the widths of the print media can range from 4.25 inches to 52 inches.

Each nozzle array 202 includes one or more lines of nozzles that jet ink drops. The ink drops have a particular pitch or spacing in the cross-web direction. The cross-web pitch is determined by the spacing between nozzles. For example, cross-web ink drop pitches can vary from 300 to 1200 drops per inch.

Figure 4:
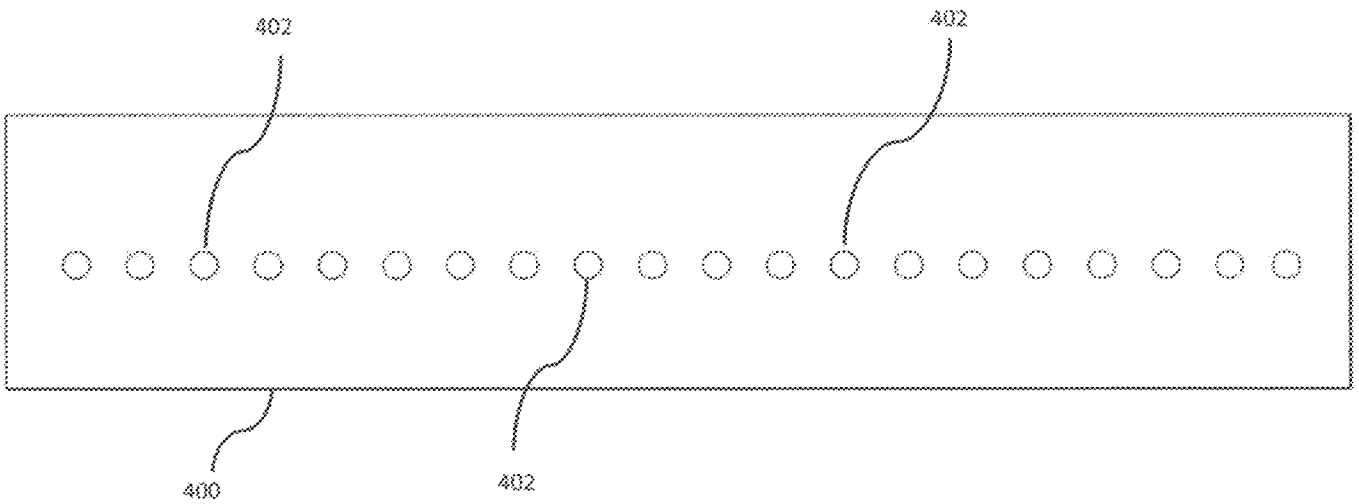
FIG. 4 depicts one example of a side of the nozzle array 202 that is adjacent to a web in an embodiment in accordance with the invention.

FIG. 4 depicts one example of a side of a nozzle plate that is adjacent to a web in an embodiment in accordance with the invention. Nozzle plate 400 includes nozzles 402. In the illustrated embodiment, nozzle plate 400 includes one row of nozzles 402. As described earlier, the nozzles 402 can be very small in size, on the order of several microns. A printhead can include other features, such as, for example, fiducials, electronic heaters and electrical contacts in embodiments in accordance with the invention.

Figure 5:
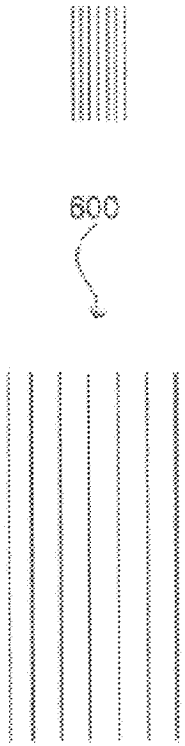

Streams of ink drops jetted from the nozzles 402 can travel a distance of about 1 to 15 mm from the nozzle plate 400 to the print media in some printing systems. FIG. 5 illustrates a desired pattern of ink drops and an expanded view of the desired pattern. The streams of ink drops are illustrated as lines for simplicity. As shown in FIG. 5, the streams of drops 600 are parallel to each other at the proper pitch. This produces a uniform density on the print media. Streams of drops which are not parallel result in variations in density that are seen as adjacent light and dark band regions. Although there are a number of different failure modes for inkjet printing systems, several of the most common failures produce artifacts that extend in the media transport direction (e.g., direction 114 in FIG. 1). In the case where a nozzle stops ejecting ink drops, a blank streak is created that continues until ink is again ejected from the nozzle.

Figure 6:
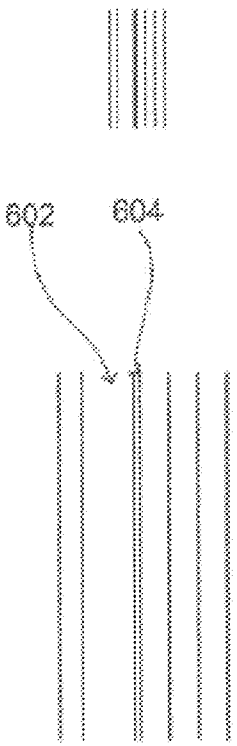
FIGS. 5-6 are graphical illustrations of examples of streams of ink drops and expanded views of the streams in an embodiment in accordance with the invention.

A "stuck on" nozzle will produce a dark line for the duration of the "stuck on" event. And as shown in FIG. 6, the ink jetted from a misplaced nozzle can result in a darker streak 604 where the two neighboring streams are closer together and an adjacent lighter streak 602 (or streaks). A uniform density is achieved when the ink drops are emitted in a uniform fashion 600 (i.e. parallel to each other at the proper pitch). Finally, ink jetted from a non-conforming nozzle can produce a misdirected stream that intersects with one or more neighboring streams. Again, this produces a darker streak and an adjacent lighter streak.

Figure 7:
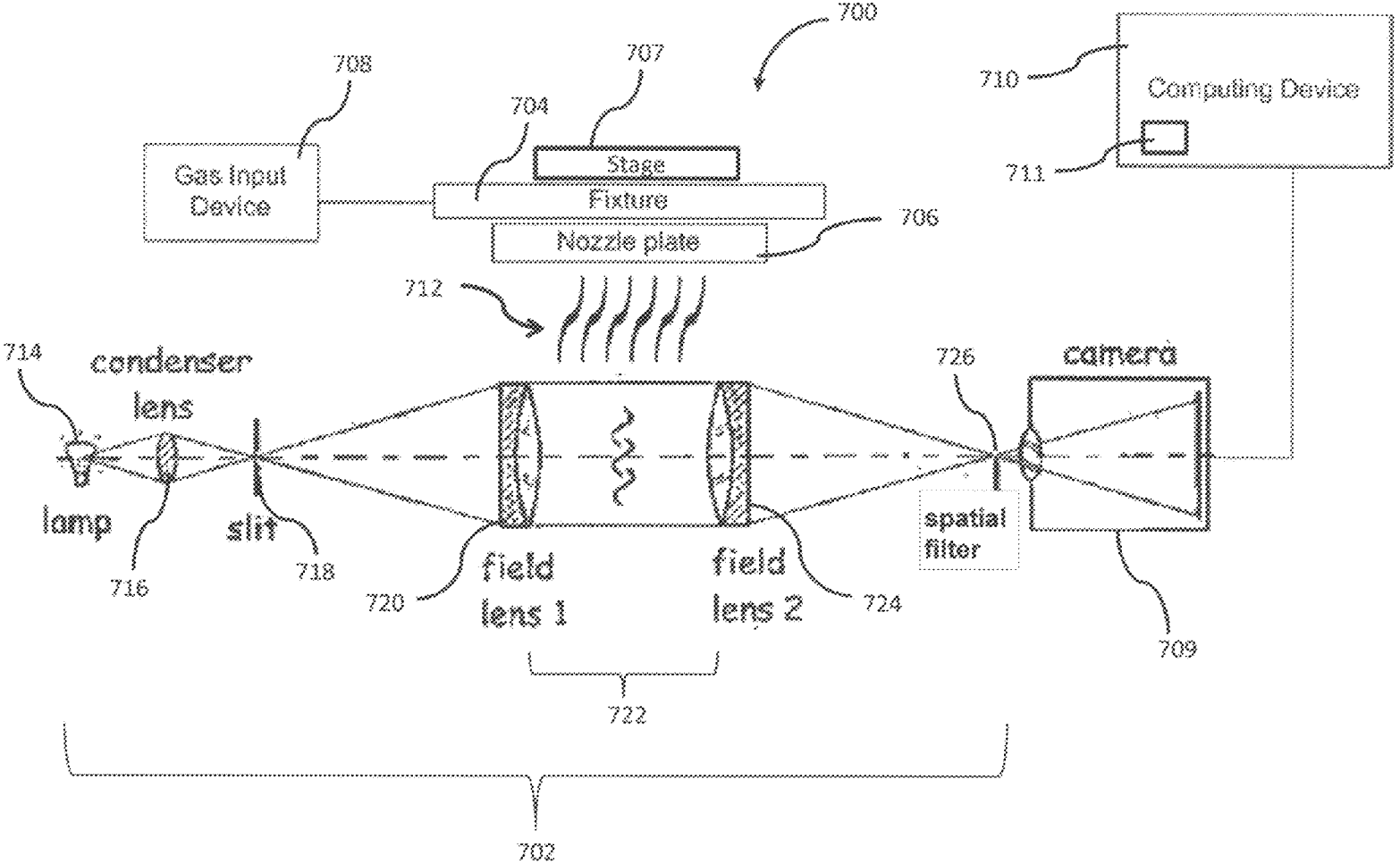
FIG. 7 depicts one example of a system that is suitable for use in testing nozzle plates in an embodiment in accordance with the invention.

Referring now to FIG. 7, there is shown one example of a system that is suitable for use in testing nozzle plates in an embodiment in accordance with the invention. System 700 includes a stationary schlieren optical system 702, a fixture 704 that holds a nozzle plate 706, a gas input device 708 connected to the fixture 704, a translation stage 707 for moving or indexing the fixture 704, an image capture device 709, and a computing device 710. The computing device 710 includes a display 711 in the illustrated embodiment. Other embodiments can connect or include a display to image capture device 709.

Gas input device 708 introduces pressurized air or gas to the fixture 704, which in turn inputs the pressurized air or gas into the nozzles (not shown) in the nozzle plate 706. The term gas is intended to be generic and include any type of transparent fluid or gas, including air. The schlieren optical system 702 is used to image the flow of the gas streams 712 jetted from the nozzles in the nozzle plate 706.

Schlieren and shadowgraph optical systems are known in the art and are therefore not described in great detail. Briefly, schlieren and shadowgraph optical systems are used to visualize refractive index variations in liquids, gases, and solids. In the illustrated embodiment, light from a light source 714 is focused with a lens 716 onto a slit 718. The light emerging from the slit 718 is collimated by a lens 720 and propagates through a test field 722. The gas streams 712 will deflect some of the light propagating through the test field 722 by virtue of a refractive index gradient.

After passing through the test field 722, the light is focused by another lens 724 onto a focal point where a spatial filter 726 is located. The spatial filter 726 can be implemented as a razor blade or knife-edge in an embodiment in accordance with the invention. In addition, the spatial filter 726 can have a variety of geometries and be made of a variety of materials chosen to optimize the performance given the specific application and type of light source used. For example, if a laser source is used, a graded ND filter can be employed to reduce speckle. Similarly, the spatial filter 726 can be a chrome-on-glass target chosen to match the geometry of the illumination pattern.

The refractive index gradient due to the gas streams 712 in the test field 722 causes some of the light to be deflected away from the focal point. For example, some portions of the light can be deflected onto the spatial filter 726 and thus blocked, resulting in dark areas in the image. Another portion of light can be deflected in a direction opposite that of the spatial filter 726 and is thus passed, resulting in a bright area in the image. A pattern of light and dark areas is produced in the image plane depending upon whether the light was blocked or passed by the spatial filter 726. The pattern of light and dark areas is a light-intensity representation of the gas streams 712 jetted from the nozzles. The image capture device 709 is used to capture images of the light-intensity representations of the gas streams (the pattern of light and dark areas). One or more characteristics or functions of the nozzles can be inferred by examining the image or images of the light-intensity representation of the gas streams.

Computing device 710 can receive the image (or images) captured by the image capture device 709 and can process the image or images. A reference image depicting gas streams jetted from conforming nozzles can be stored in the computing device 710, and the computing device 710 can compare the captured image to the reference image to determine whether the gas streams jetted from the nozzles indicate the nozzles are of sufficient quality (e.g., substantially straight and parallel to each other). The computing device 710 can also be used to apply other image processing techniques to the image or images, such as noise reduction and background subtraction algorithms, contrast enhancement techniques, and algorithms to calculate the characteristics of the streams, such as, for example, the angle of a stream or streams with respect to the nozzle plate surface normal. The computing device 710 can also be used to display the image on a display screen 711 attached to or included in computing device 710.

In place of the image capture device 709 and the computing device 710, a screen (not shown) can be provided for direct viewing of the light-intensity representation(s) of the gas streams.

As discussed earlier, any type of transparent gas can be used in a schlieren or shadowgraph optical system. In one embodiment in accordance with the invention, a gas having a different index of refraction than the ambient atmosphere is used. In another embodiment in accordance with the invention, a customized ambient atmosphere that is different from the normal atmosphere is created to allow for the use of a particular gas.

Typical prior art applications that use schlieren and shadowgraph techniques test objects of a much larger scale than embodiments of the present invention. Prior art objects are generally at least two orders of magnitude larger (e.g., millimeters to meters). For example, prior art schlieren systems have been used to image airflow around aircraft and automobiles, the shockwaves caused by supersonic objects such as bullets traveling through air, and the air currents as heated by a candle. In contrast, the present invention involves inkjet nozzles, which are approximately 10 microns in diameter. This requires optimization of a schlieren optical system to produce high resolution and high schlieren sensitivity in an embodiment in accordance with the invention. High schlieren sensitivity and resolution require the use of high quality imaging components, well corrected for aberrations. Schlieren sensitivity is also proportional to the amount of beam cutoff by the spatial filter 726 and to the focal length of the second lens 724. In practice, the resolution is reduced with a larger amount of cutoff, so the optical design provides a careful balance. In addition, source attributes and spatial filter attributes must be carefully considered. By way of example only, a blue LED is focused onto a slit, a 50 mm lens is used to collimate the light in the test field 722 and a 200 mm photographic lens is used to image the schlieren plane onto the image capture device or screen and to focus the collimated light at the spatial filter 726. The spatial filter 726 is adjusted to optimize schlieren contrast, generally blocking around 90-95% of the light.

Other embodiments in accordance with the invention can construct a schlieren optical system differently. For example, a schlieren optical system can use mirrors in place of lenses 720, 724. Alternatively, additional lenses can be included in the system. The schlieren optical system can be arranged differently, such as, for example, in a Z pattern that uses mirrors to reflect the light. A variety light sources can be used, such as traditional incandescent or fluorescent lamps, lasers, laser diodes, and LEDs. A variety of spatial filters can be used as well. For example, a knife edge, apertures of various geometries such as slits, round apertures, or round masks, ND filters, reflective gratings, and combinations thereof can be used.

Additionally, a shadowgraph system can be substituted for a schlieren optical system in some embodiments in accordance with the invention. Shadowgraphy also detects refractive index variations, but shadowgraph systems are typically simpler and less sensitive compared to schlieren optical systems.

Figure 8:
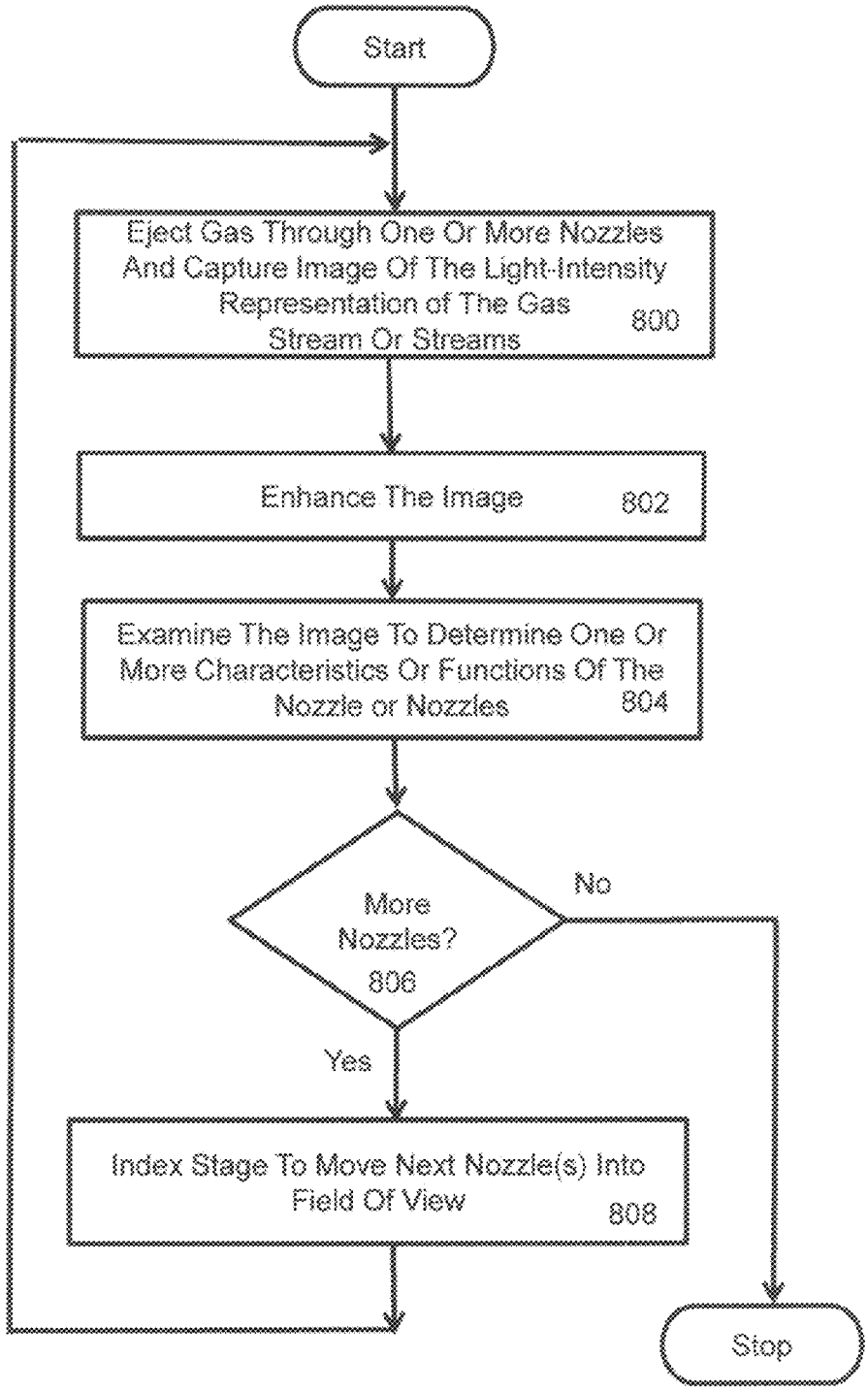
FIG. 8 is a flowchart of a first method for testing nozzles in an nozzle plate in an embodiment in accordance with the invention.

Referring now to FIG. 8, there is shown a flowchart of a first method for testing nozzles in a nozzle plate in an embodiment in accordance with the invention. Initially, gas is jetted from one or more nozzles, and an image is captured of the light-intensity representation of the gas stream or streams (block 800). The image is enhanced at block 802. One or more characteristics of the gas stream or streams shown in the image is examined to infer one or more characteristics or functions of the nozzle(s) (block 804). The image can be visually examined or the image can be analyzed by a computing device. Nozzle characteristics or functions can be inferred by assessing, for example, the following gas stream characteristics or attributes: the angle of the gas stream jetted with respect to the neighboring streams or with respect to the nozzle plate surface normal, or the break-up distance of the gas stream.

A determination is then made at block 806 as to whether or not there are additional nozzles that need to be tested. If not, the method ends. If there are additional nozzles to be tested, the stage is indexed to move the next nozzle or group of nozzles into the field of view (block 808). The process repeats until all of the nozzles in the nozzle plate to be tested have been tested.

Other embodiments in accordance with the invention can add additional blocks, omit some or all of the blocks, or modify some of the blocks shown in FIG. 8. For example, block 802 can be omitted in an embodiment in accordance with the invention. Alternatively, block 806 can be omitted in systems that test the nozzles individually or that test all of the nozzles in a nozzle plate at once. Block 800 can be modified by projecting the light-intensity representation of the gas stream or streams onto a screen instead of capturing an image of the light-intensity representation. When viewing on a screen, block 802 can be omitted and block 804 modified to examine the light-intensity representation of the gas stream (s) to determine one or more characteristics or functions of the nozzle(s).

Figure 9:
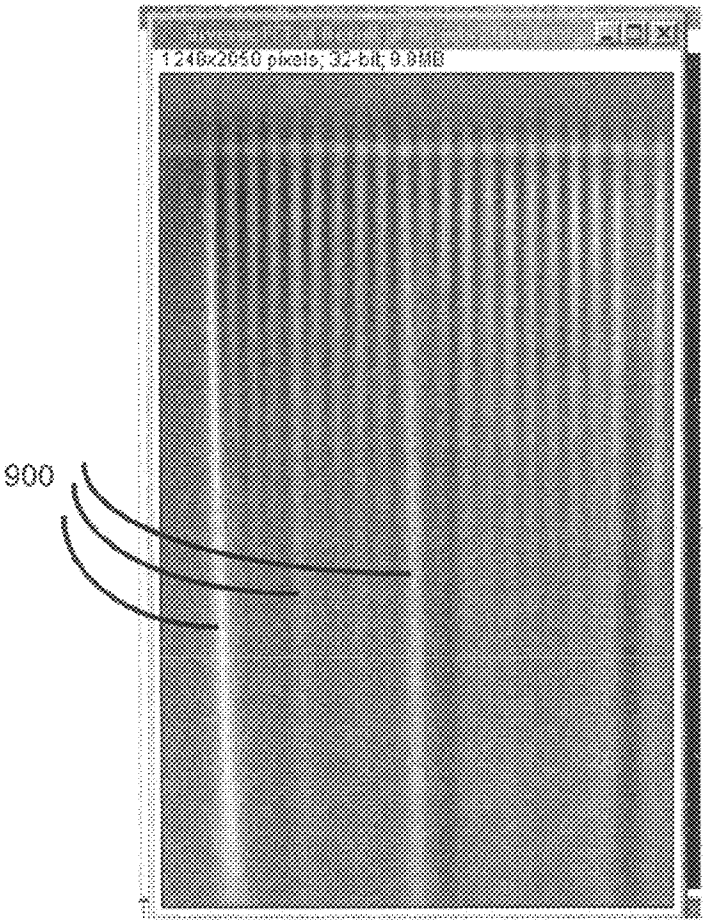
FIG. 9 is an example of an image illustrating a light-intensity representation of gas streams jetted from nozzles in an embodiment in accordance with the invention.

FIG. 9 is an example of an image illustrating a light-intensity representation of gas streams jetted from nozzles in an embodiment in accordance with the invention. Gas streams 900 are not parallel with adjacent streams in the illustrated embodiment, indicating improper functioning of the nozzles. Improperly functioning nozzles can deteriorate print quality.

Figure 10:
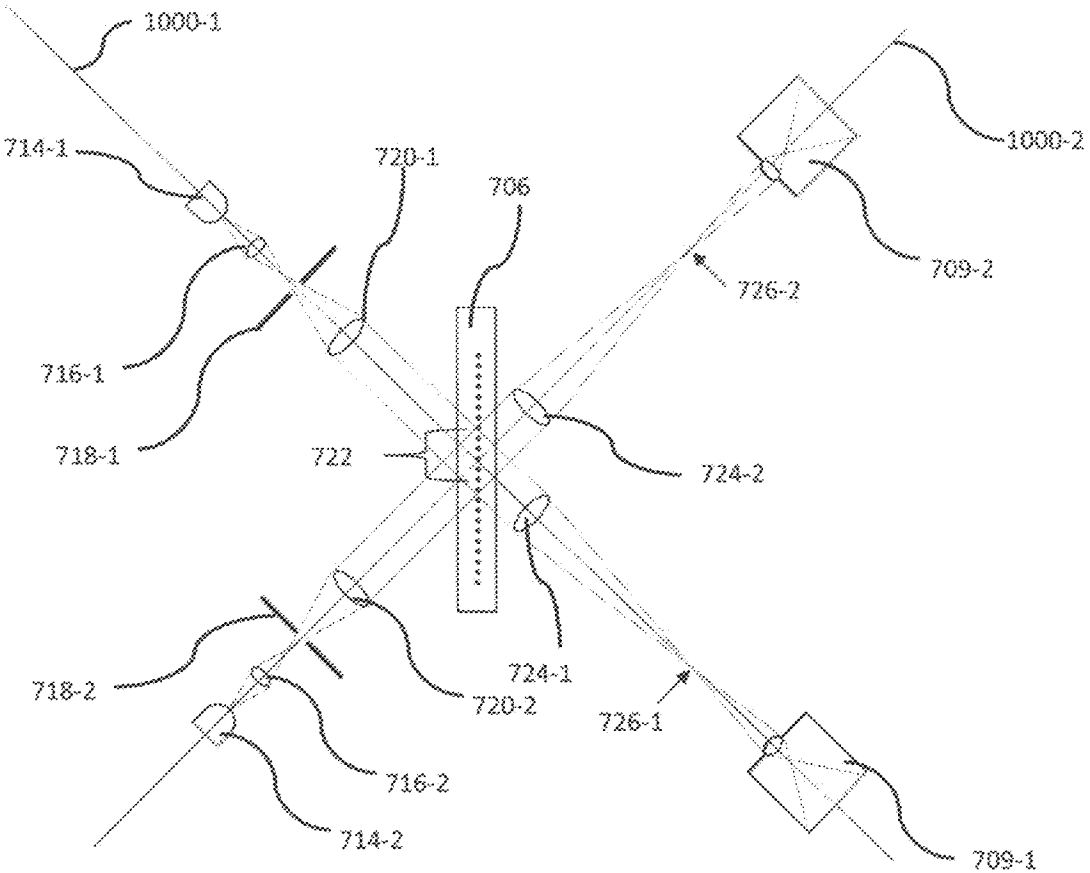
FIG. 10 illustrates another example of a system that is suitable for use in testing nozzle plates in an embodiment in accordance with the invention.

Referring now to FIG. 10, there is shown another example of a system that is suitable for use in testing nozzle plates in an embodiment in accordance with the invention. FIG. 10 illustrates in plan view an embodiment of the invention which implements two stationary schlieren optical systems to image the gas streams from different angles. The reference signs from FIG. 7 are used in FIG. 10 for the components of the schlieren optical systems and the image capture devices.

In FIG. 10, the optical axes 1000-1, 1000-2 of the two stationary schlieren optical systems are arranged at a 90 degree angle to each other with each optical axis 1000-1, 1000-2 forming an angle of 45 degrees with the nozzle array. Each schlieren optical system is arranged to image the same gas stream or group of gas streams. Other embodiments in accordance with the invention can arrange the two stationary schlieren optical systems at a different angle to each other. Additionally, each optical axis 1000-1, 1000-2 can form a different angle with the nozzle array.

By imaging in this fashion, the angle made by a gas stream within the plane of the array of gas streams and perpendicular to the plane of the array of gas streams can be inferred. Imaging the gas streams from two distinct angles can provide additional information. The shape of the gas stream or streams can be discerned and additional inferences on the characteristics or functions of the nozzle can be made. By way of example only, deviations from cirularity or the presence of occlusions, which degrade the flow, can be inferred.

Image capture devices 709-1, 709-2 can be connected to the same computing device (e.g., computing device 710) or to separate computing devices in an embodiment in accordance with the invention. Alternatively, the image capture devices 709-1, 709-2 can be omitted and the light-intensity representations of the gas stream(s) can be projected onto one or more screens in another embodiment in accordance with the invention.

Figure 11A:
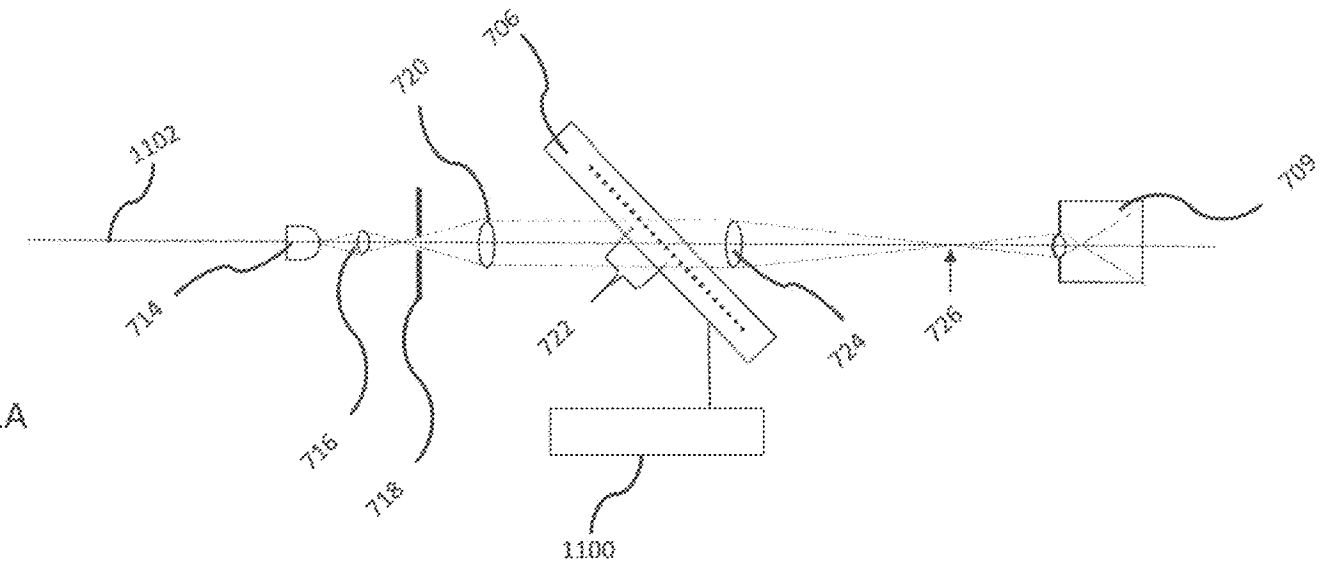
FIGS. 11A-11B depict another example of a system that is suitable for use in testing nozzle plates in an embodiment in accordance with the invention.
Figure 11B:
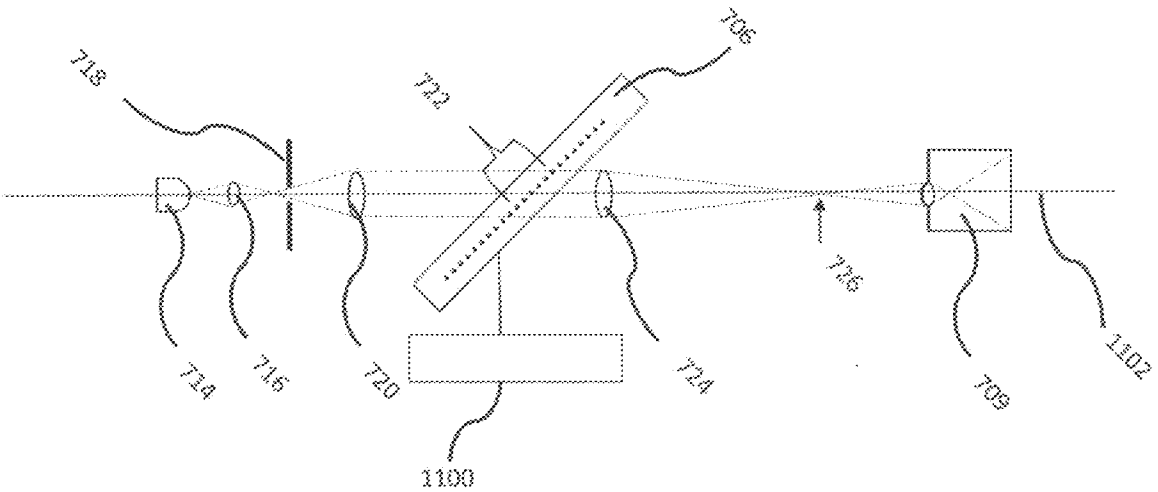

FIGS. 11A-11B depict another example of a system that is suitable for use in testing nozzle plates in an embodiment in accordance with the invention. Only one schlieren optical system is used and a gas stream or streams is imaged and analyzed twice. For simplicity, the fixture, gas input device, translation stage, and computing device and display shown in FIG. 7 are not shown in FIGS. 11A and 11B, but these components are included in the embodiment. Other embodiments can connect a display to image capture device or substitute a screen for the image capture device.

In FIG. 11A, the optical axis 1102 of the schlieren optical system forms an angle of positive 45 degrees with respect to the nozzle plate 706. The image capture device 709 captures one or more images of the light-intensity representation(s) of the gas stream or streams while the optical axis 1102 is at an angle of positive 45 degrees with respect to the nozzle plate 706.

In FIG. 11B, the optical axis 1102 of the schlieren optical system forms an angle of negative 45 degrees with respect to the nozzle plate 706. The image capture device 709 captures one or more images of the light-intensity representation(s) of the gas stream or streams while the optical axis 1102 is at an angle of negative 45 degrees with respect to the nozzle plate 706. Adjustment of the relative angle between the optical axis 1102 and the nozzle plate 706 can be achieved by pivoting either the schlieren optical system, or the nozzle plate 706. The nozzle plate 706 is pivoted by pivoting the fixture in the illustrated embodiment. Pivoting of the fixture, nozzle plate or the schlieren optical system can be performed manually or by a motorized system. In the illustrated embodiment, a motorized system 1100 is shown connected to the fixture to pivot the nozzle plate 706. Alternatively, in other embodiments, the translation stage can be used to pivot the fixture or the nozzle plate 706.

The analysis of both images allows the angle made by a gas stream within the plane of the array of gas streams and perpendicular to the plane of the array of gas streams to be determined. In other embodiments in accordance with the invention, the angle of the optical axis (for one or both images) with respect to the nozzle plate can be arranged at different angles. By imaging the gas stream or streams from two distinct angles, additional information regarding the shape of the stream can be discerned and additional inferences on the characteristics or functions of the nozzle can be made. For example, deviations from circularity or the presence of occlusions, which degrade the flow, can be inferred.

Figure 12:
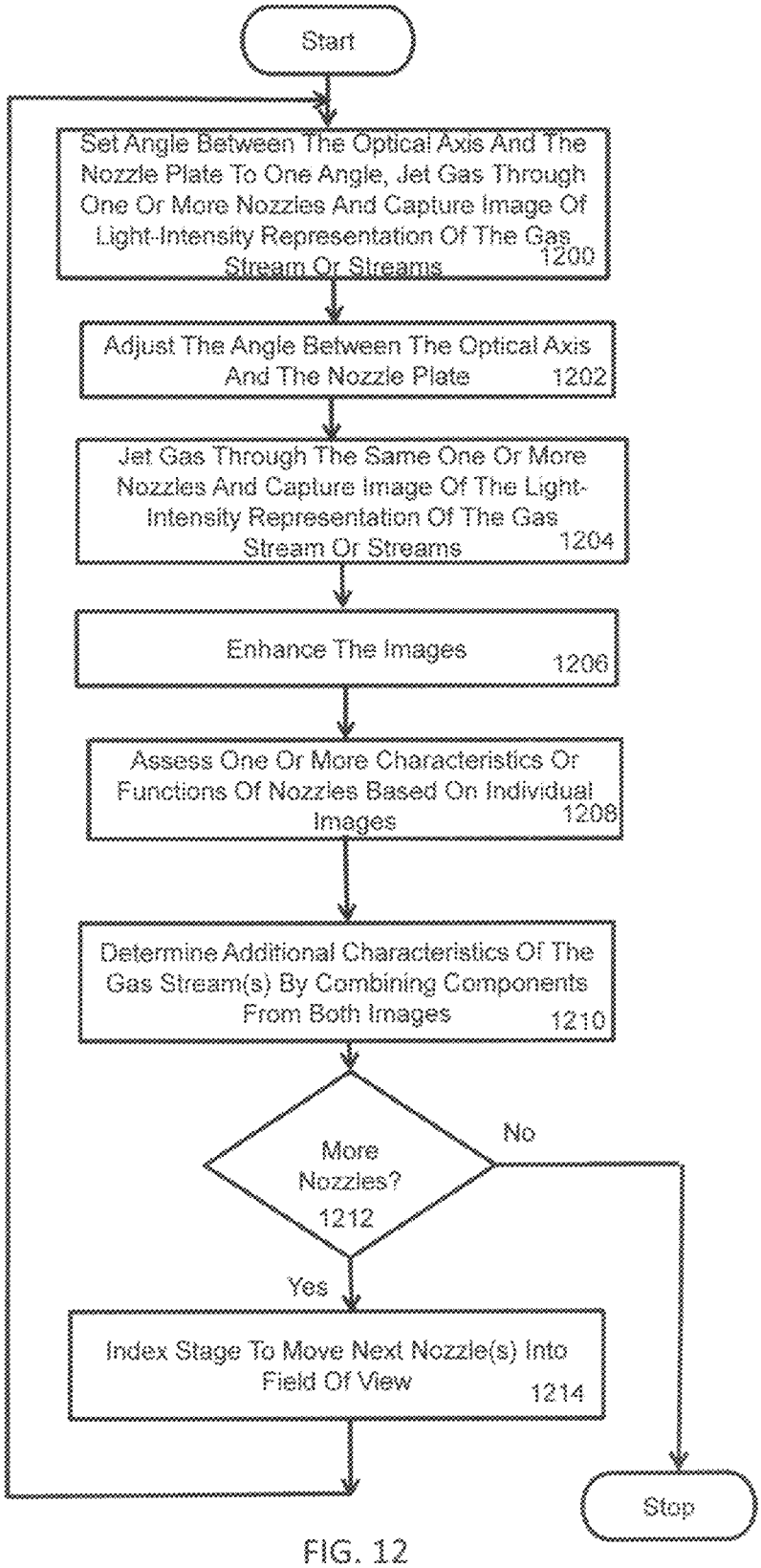
FIG. 12 is a flowchart of a second method for testing nozzles in a nozzle plate in an embodiment in accordance with the invention.

Referring now to FIG. 12, there is shown a flowchart of a second method for testing nozzles in a nozzle plate in an embodiment in accordance with the invention. Initially, the angle between the optical axis of the schlieren optical system and the nozzle plate is set to a particular angle, gas is jetted from one or more nozzles, and an image is captured of the light-intensity representation of the gas stream or streams (block 1200). The angle between the optical axis of the schlieren optical system and the nozzle plate is then adjusted to a different angle (block 1202). Gas stream or streams is again jetted from the same one or more nozzles and an image is captured of the light-intensity representation of the gas stream or streams (block 1204).

The images are then enhanced at block 1206 and one or more characteristics of the gas stream or streams is examined in order to infer one or more characteristics or functions of the nozzles (block 1208). Nozzle characteristics or functions can be inferred by assessing, for example, the following gas stream characteristics or attributes: the angle of the gas stream with respect to the neighboring gas streams or with respect to the nozzle plate surface normal, or the break-up distance of the gas stream or streams.

Additional inferences about the nozzle or nozzles can be made at block 1210 by combining measurements made from both images. The analysis of both images allows the angle made by a gas stream within the plane of the array of gas streams and perpendicular to the plane of the array of gas streams to be determined.

A determination is then made at block 1212 as to whether or not there are additional nozzles that need to be tested. If not, the method ends. If there are additional nozzles to be tested, the stage is indexed to move the next nozzle or group of nozzles into the field of view (block 1214). The process repeats until all of the nozzles in the nozzle plate to be tested have been tested.

Other embodiments in accordance with the invention can add additional blocks, omit some or all of the blocks, or modify some of the blocks shown in FIG. 12. For example, block 1206 can be omitted in an embodiment in accordance with the invention. Alternatively, block 1212 can be omitted in systems that test the nozzles individually or that test all of the nozzles in a nozzle plate at once.

Figure 13:
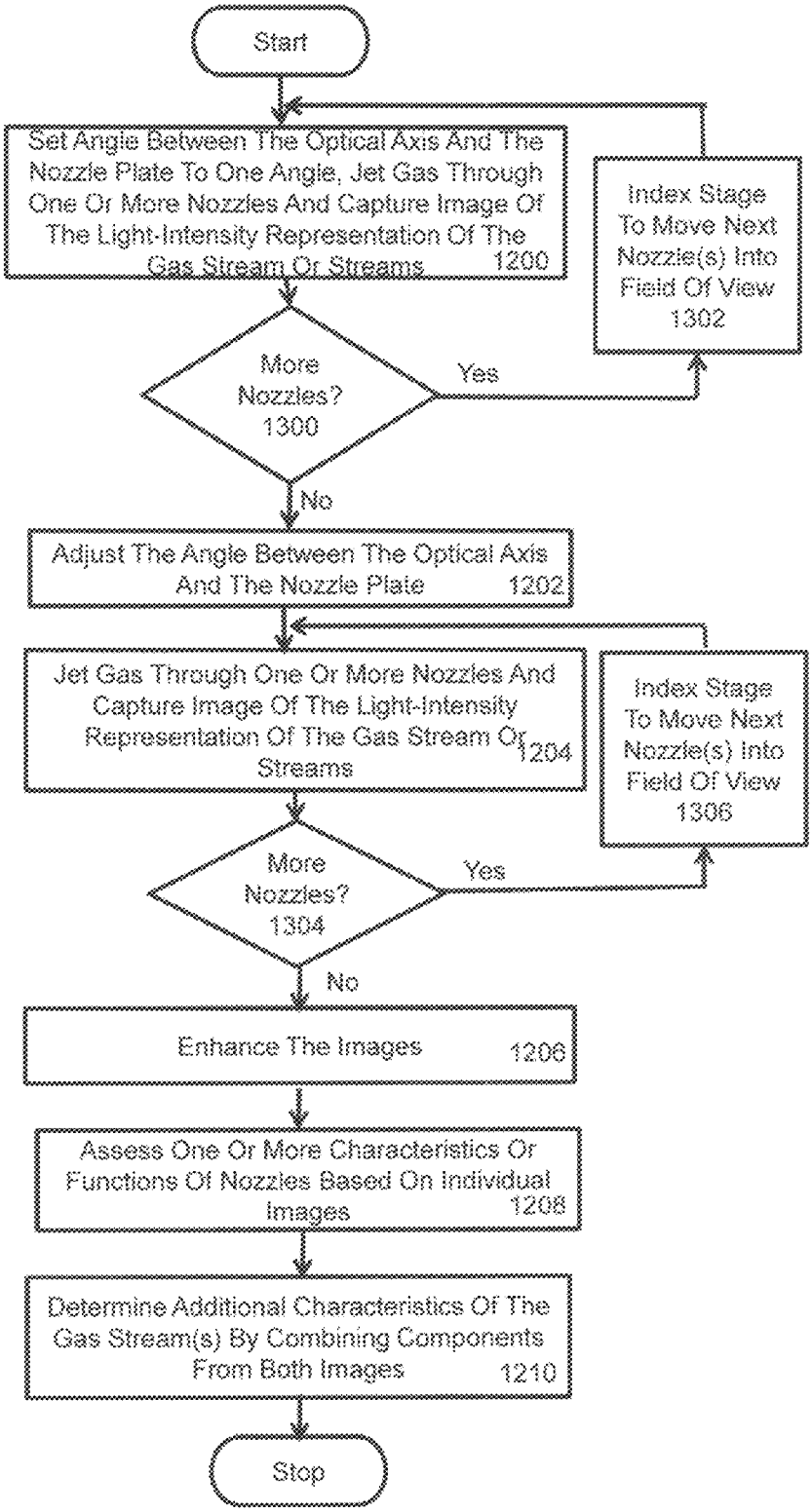
FIG. 13 is a flowchart of a third method for testing nozzles in a nozzle plate in an embodiment in accordance with the invention.

FIG. 13 is a flowchart of a third method for testing nozzles in a nozzle plate in an embodiment in accordance with the invention. The method depicted in FIG. 13 includes blocks illustrated in FIG. 12. As such, the reference signs from these same blocks are used in FIG. 13 and the descriptions of these blocks are not duplicated here. In the method of FIG. 13, all of the nozzles to be tested are measured while angle between the optical axis of the schlieren optical system and the nozzle plate is configured at a particular first angle. The angle between the optical axis of the schlieren optical system and the nozzle plate is then adjusted to a different second angle, and all of the nozzles to be tested are measured again. Blocks 1300 and 1302 illustrate the process of measuring all of the nozzles to be tested at the first angle. Blocks 1304 and 1306 represent the process of measuring all of the nozzles to be tested at the second angle.

Other embodiments in accordance with the invention can omit some or all of the blocks shown in FIG. 13. For example, block 1206 can be omitted in an embodiment in accordance with the invention. Alternatively, blocks 1300 and 1304 can be omitted in systems that test the nozzles individually or that test all of the nozzles in a nozzle plate at once.

The invention has been described in detail with particular reference to certain preferred embodiments thereof, but it will be understood that variations and modifications can be effected within the spirit and scope of the invention. And even though specific embodiments of the invention have been described herein, it should be noted that the application is not limited to these embodiments. In particular, any features described with respect to one embodiment may also be used in other embodiments, where compatible. And the features of the different embodiments may be exchanged, where compatible.

1. A system for testing a nozzle in a nozzle plate can include a fixture for holding the nozzle plate; a gas input device for jetting gas through the nozzle; a first schlieren optical system that produces a light-intensity representation of a gas stream jetted from the nozzle; and a first image capture device for capturing an image of the light-intensity representation of the gas stream jetted from the nozzle.

2. The system in clause 1 can include a display for displaying the image.

3. The system in clause 1 or clause 2 can include a translation stage for moving the nozzle plate.

4. The system in any one of clauses 1-3 can include a computing device connected to the image capture device.

5. The system as in clause 4, wherein the first schlieren optical system comprises a first stationary schlieren optical system.

6. The system as in clause 5, further comprising a second stationary schlieren optical system and a second image capture device, where an angle between the nozzle plate and an optical axis of the first stationary schlieren optical system is different from an angle between the nozzle plate and an optical axis of the second stationary schlieren optical system.

7. The system as in clause 6, wherein the second image capture device is connected to the computing device.

8. The system in any one of clauses 1-4 can include a motorized system for adjusting a relative angle between the nozzle plate and an optical axis of the schlieren optical system.

9. A system for testing a nozzle in a nozzle plate can include a fixture for holding the nozzle plate; a gas input device for jetting gas through the nozzle; a first stationary schlieren optical system that produces a light-intensity representation of a gas stream jetted from the nozzle; and a first screen for viewing the light-intensity representation of the gas stream jetted from the nozzle.

10. The system in clause 9 can include a translation stage for moving the nozzle plate.

11. A method for testing a nozzle in a nozzle plate can include jetting gas through the nozzle; forming one or more light-intensity representations of a gas stream jetted from the nozzle using at least one stationary schlieren optical system; and capturing one or more images of the one or more light-intensity representations of the gas stream jetted from the nozzle.

12. The method in clause 11 can include displaying one or more images.

13. The method as in clause 12, where forming one or more light-intensity representations of a gas stream jetted from the nozzle using at least one stationary schlieren optical system comprises forming a light-intensity representation of a gas stream jetted from the nozzle using a stationary schlieren optical system.

14. The method as in clause 13, where capturing one or more images of the one or more light-intensity representations of the gas stream jetted from the nozzle comprises capturing one or more images of the light-intensity representation of the gas stream jetted from the nozzle.

15. The method in clause 14 can include visually examining one or more images to determine whether the gas stream jetted from the nozzle indicates the nozzle functions properly.

16. The method in any one of clauses 11-14 can include processing one or more images using a computing device to determine whether a nozzle is functioning properly.

17. A method for testing a nozzle in a nozzle plate can include jetting gas through the nozzle; forming a light-intensity representation of a gas stream jetted from the nozzle using a stationary schlieren optical system; and projecting onto a screen the light-intensity representation of the gas stream jetted from the nozzle.

18. The method in clause 17 can include visually examining the light-intensity representation to determine whether the gas stream jetted from the nozzle indicates the nozzle is functioning properly.

19. A method for testing a nozzle in a nozzle plate can include setting an angle of the nozzle plate with respect to an optical axis of a schlieren optical system to a first angle; jetting gas through the nozzle; forming a first light-intensity representation of the gas stream jetting from the nozzle using the schlieren optical system; capturing a first image of the first light-intensity representation; adjusting the angle of the nozzle plate with respect to the optical axis of the schlieren optical system to a different second angle; forming a second light-intensity representation of the gas stream jetting from the nozzle using the schlieren optical system; and capturing a second image of the second light-intensity representation.

20. The method in clause 19 can include analyzing the first and second images to determine whether the nozzle is functioning properly.

21. The method in clause 19 or clause 20 can include combining measurements from the first and second images.

22. The method as in clause 19, where adjusting the angle of the nozzle plate with respect to the optical axis of the schlieren optical system to a different second angle comprises pivoting the nozzle plate to adjust the angle of the nozzle plate with respect to the optical axis of the schlieren optical system to a different second angle.

PARTS LIST

100 printing system
102 printing module
104 printing module
106 linehead
108 dryer
110 quality control sensor
112 print media
114 transport direction
116 turnover module
200 printhead
202 nozzle array
204 support structure
206 heat
300 overlap region
400 nozzle plate
402 nozzles
600 uniform streams
602 lighter streak
604 darker streak
700 system
702 schlieren optical system
704 fixture
706 nozzle plate
707 translation stage
708 gas input device
709 image capture device
710 computing device
711 display
712 gas stream
714 light source
716 lens
718 slit
720 lens
722 test field
724 lens
726 spatial filter
900 gas stream
1000-1 optical axis
1000-2 optical axis
1100 motorized system
1102 optical axis

The invention claimed is:

1. A method for testing a nozzle in a nozzle plate; comprising:

setting an angle of the nozzle plate with respect to an optical axis of a schlieren optical system to a first angle;

jetting gas through the nozzle;

forming a first light-intensity representation of the gas stream jetting from the nozzle using the schlieren optical system;

capturing a first image of the first light-intensity representation;

adjusting the angle of the nozzle plate with respect to the optical axis of the schlieren optical system to a different second angle;

forming a second light-intensity representation of the gas stream jetting from the nozzle using the schlieren optical system; and capturing a second image of the second light-intensity representation.

2. The method as in claim 1, further comprising analyzing the first and second images to determine whether the nozzle is functioning properly.

3. The method as in claim 1, further comprising combining measurements from the first and second images.

4. The method as in claim 1, wherein adjusting the angle of the nozzle plate with respect to the optical axis of the schlieren optical system to a different second angle comprises pivoting the nozzle plate to adjust the angle of the nozzle plate with respect to the optical axis of the schlieren optical system to a different second angle.

* * * * *